US005342056A

United States Patent [19]

Ajaji

[11] Patent Number: 5,342,056

[45] Date of Patent: Aug. 30, 1994

[54] BOARD GAME APPARATUS

[76] Inventor: Lamia A. A. Ajaji, P.O. Box 38535, Dahran, Doha Camp, Saudi Arabia, 31942

[21] Appl. No.: 939,655

[22] Filed: Sep. 3, 1992

[51] Int. Cl.[5] ..... A63F 3/00; A63F 9/18

[52] U.S. Cl. ..... 273/237; 273/256; 273/430; 273/DIG. 24

[58] Field of Search ..... 273/237, 256, 243, 249–254, 273/429–432, DIG. 24

[56] References Cited

U.S. PATENT DOCUMENTS 5,067,720 11/1991 Bundy ..... 273/237

5,080,369 1/1992 Mongno ..... 273/243

*Primary Examiner*—Benjamin H. Layno

*Attorney, Agent, or Firm*—E. Michael Combs

[57] ABSTRACT

A board game includes a housing container to secure a foldable game board having first and second card groups to accommodate singles or team play. The game is directed to acquire property in four categories and to effect play until ultimate finish of the four categories and response to questions upon landing upon one of a plurality of "crown" spaces throughout the board is effected. The game further includes acquisition tokens shaped to correspond to the properties. Each acquisition token is illuminatable such that when a player acquires a property the corresponding acquisition token is illuminated to visually indicate acquisition of that property.

1 Claim, 5 Drawing Sheets

BOARD GAME APPARATUS

BACKGROUND OF THE INVENTION

1. Field of the Invention

The field of invention relates to board game apparatus, and more particularly pertains to a new and improved board game apparatus directed to the acquisition of property and proper response to questions relative to singles or team play among players.

2. Description of the Prior Art

Board game apparatus of various types have been utilized throughout the prior art for the entertainment and amusement of individuals. Such board game apparatus is exemplified in the U.S. Pat. Nos. 4,787,639; 4,902,020; 4,840,382; 4,962,934; and 4,955,616.

The instant invention is directed to the use of a board game apparatus not addressed in the prior art to associate reward relative to proper response, as well as to chance travel about a game board and in this respect, the present invention substantially fulfills this need.

SUMMARY OF THE INVENTION

In view of the foregoing disadvantages inherent in the known types of board game apparatus now present in the prior art, the present invention provides a board game apparatus wherein elements of chance and knowledge are employed to effect acquisition and proper response to various encounters about a game board. As such, the general purpose of the present invention, which will be described subsequently in greater detail, is to provide a new and improved board game apparatus which has all the advantages of the prior art board game apparatus and none of the disadvantages.

To attain this, the present invention provides a board game including a housing container to secure a foldable game board having first and second card groups to accommodate singles or team play. The game is directed to acquire property in four categories and to effect play until ultimate finish of the four categories and response to questions upon landing upon one of a plurality of "crown" spaces throughout the board is effected.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game apparatus which has all the advantages of the prior art board game apparatus and none of the disadvantages.

It is another object of the present invention to provide a new and improved board game apparatus which may be easily and efficiently manufactured and marketed.

It is a further object of the present invention to provide a new and improved board game apparatus which is of a durable and reliable construction.

An even further object of the present invention is to provide a new and improved board game apparatus which is susceptible of a low cost of manufacture with regard to both materials and labor, and which accordingly is then susceptible of low prices of sale to the consuming public, thereby making such board game apparatus economically available to the buying public.

Still yet another object of the present invention is to provide a new and improved board game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
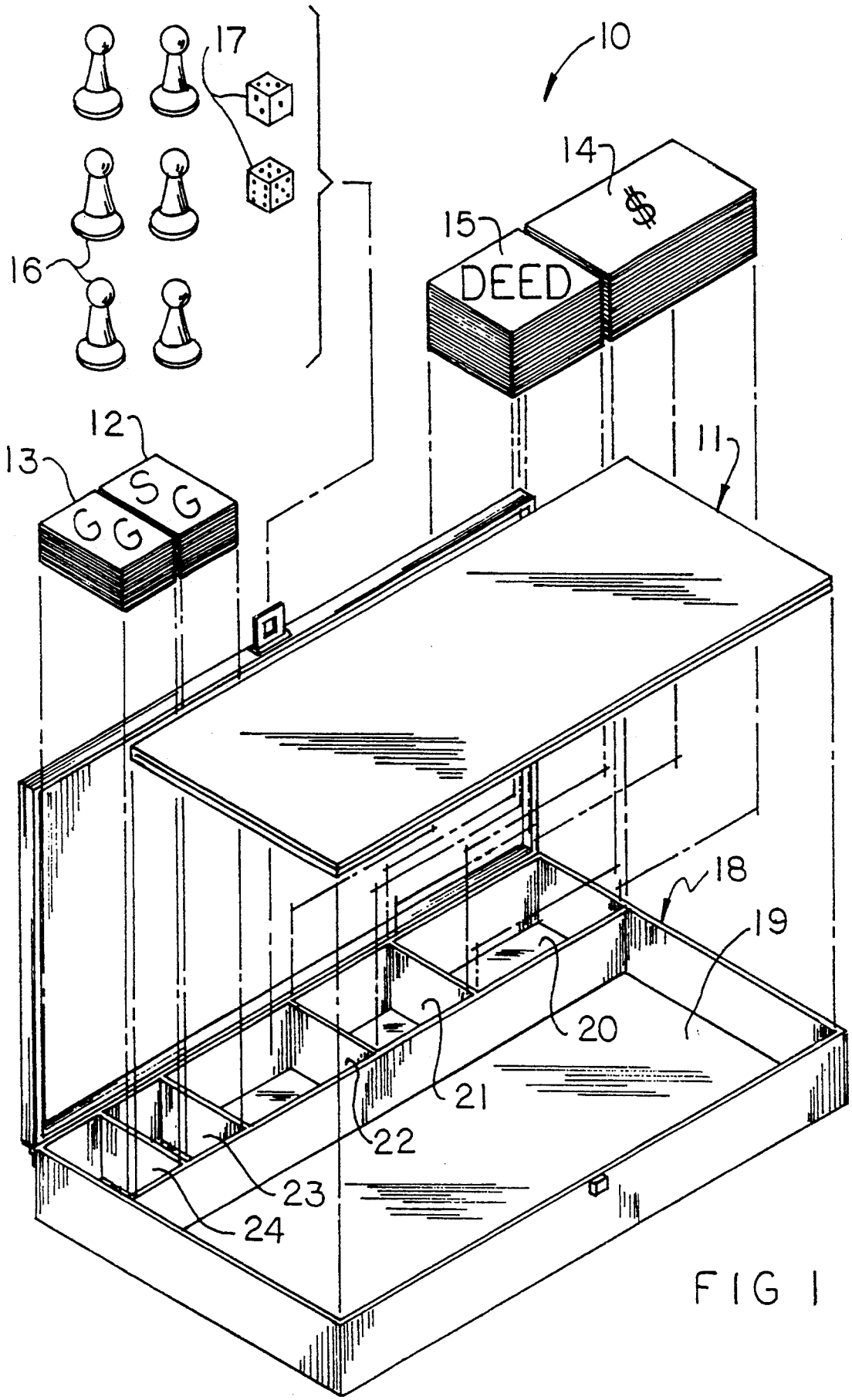
FIG. 1 is an isometric illustration of the instant invention.
Figures 2, 3:
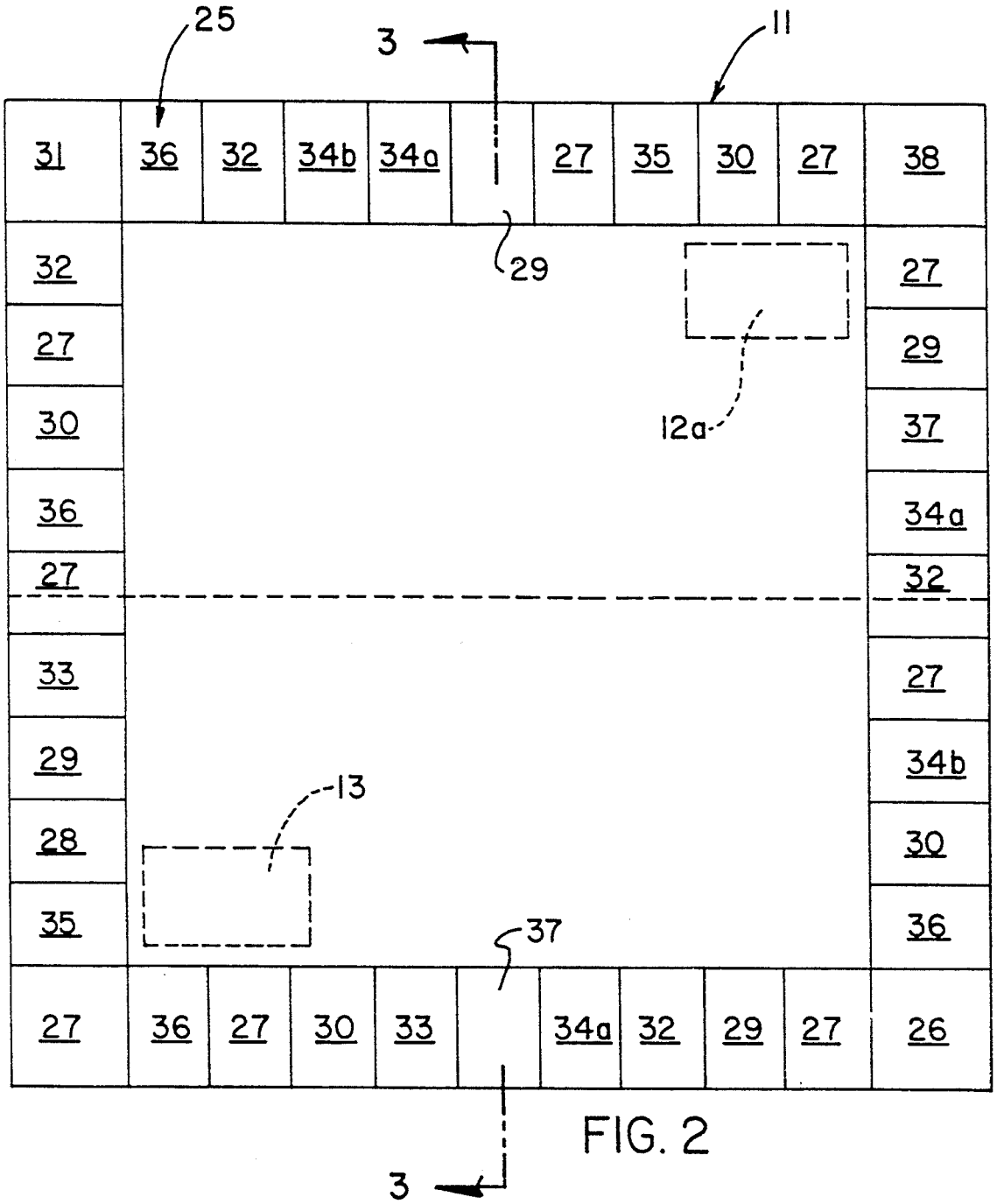
FIG. 2 is an orthographic top view of the game board structure of the instant invention.
FIG. 3 is an orthographic view, taken along the lines 3—3 of FIG. 2 in the direction indicated by the arrows.
Figure 4:
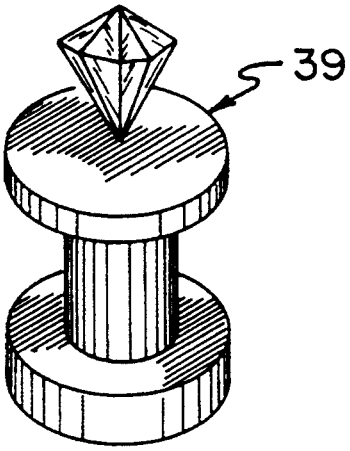
FIGS. 4, 5, 6, 7, 8, 9, and 10 are isometric illustrations of various modified token structure utilized by the invention.
Figure 5:
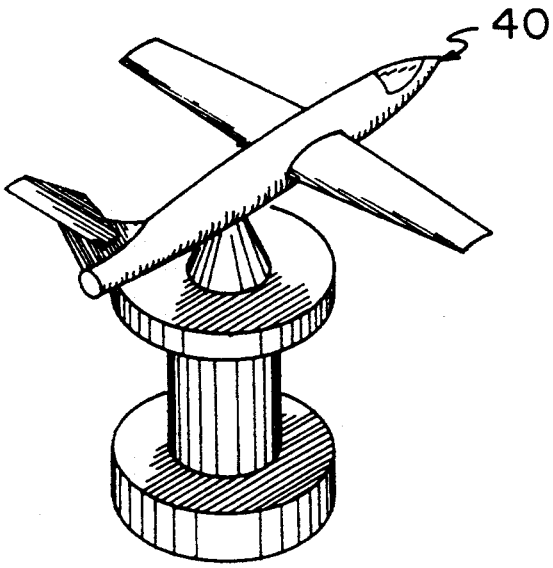
Figure 6:
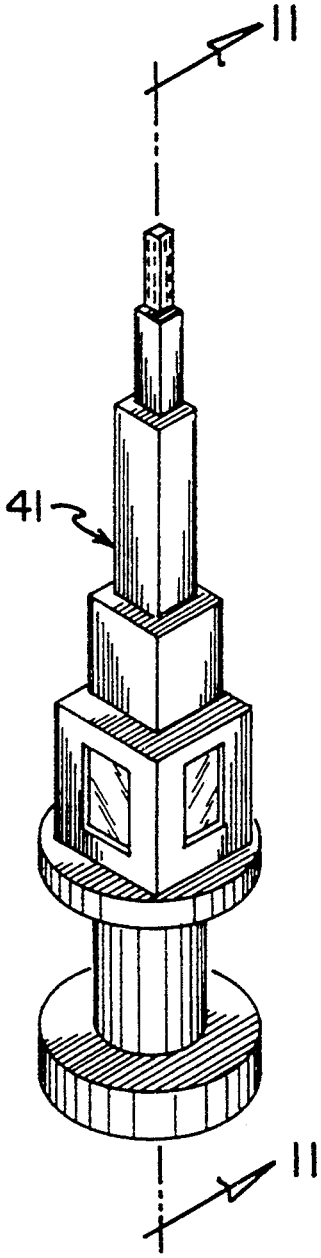
Figure 7:
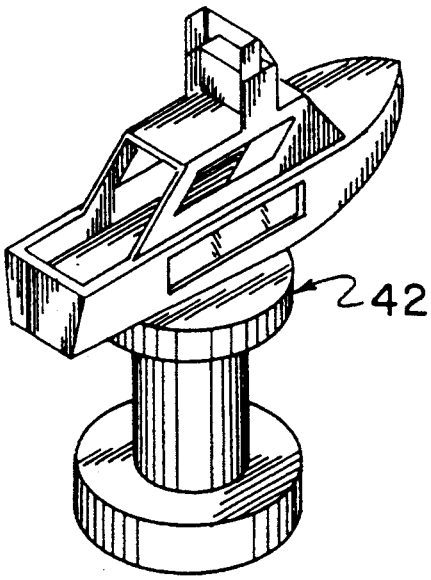
Figure 8:
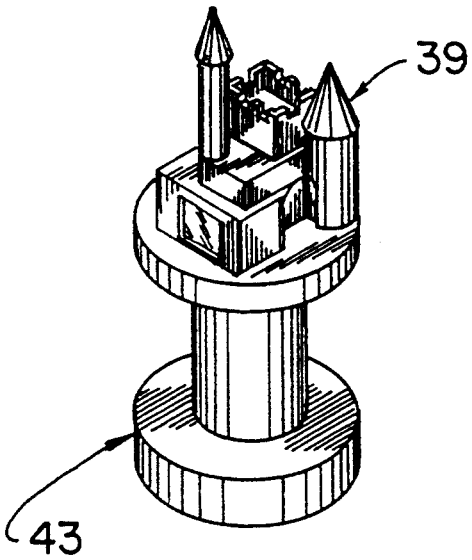
Figure 9:
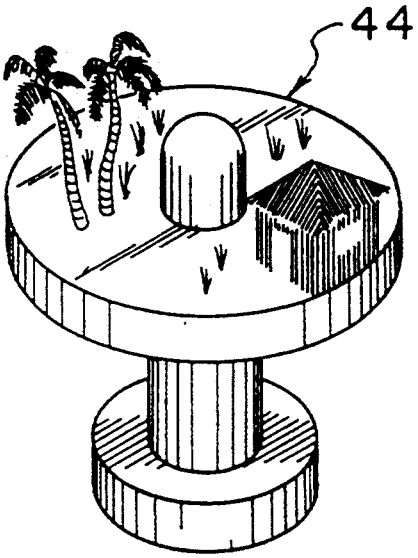
Figure 10:
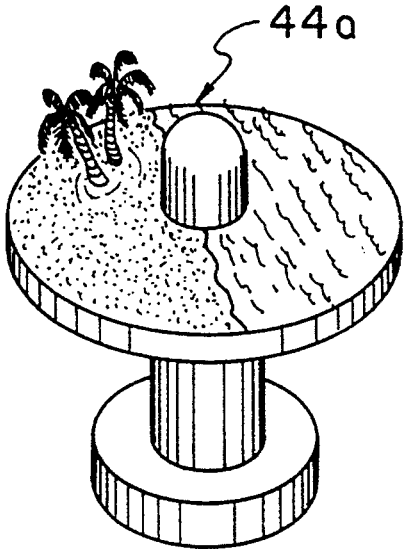
Figure 12:
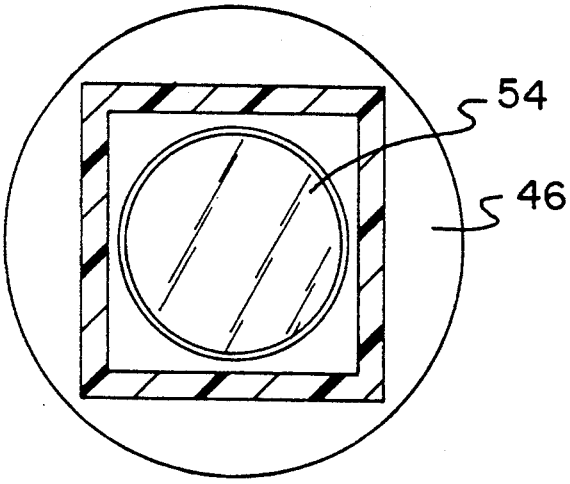
FIG. 12 is an orthographic view, taken along the lines 12—12 of FIG. 11 in the direction indicated by the arrows.
Figure 13:
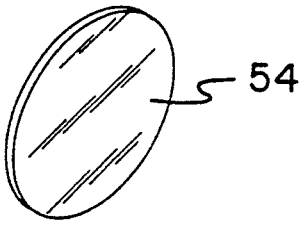
FIG. 13 is an isometric illustration of the lens structure utilized by the token, as indicated in FIG. 11.
Figure 11:
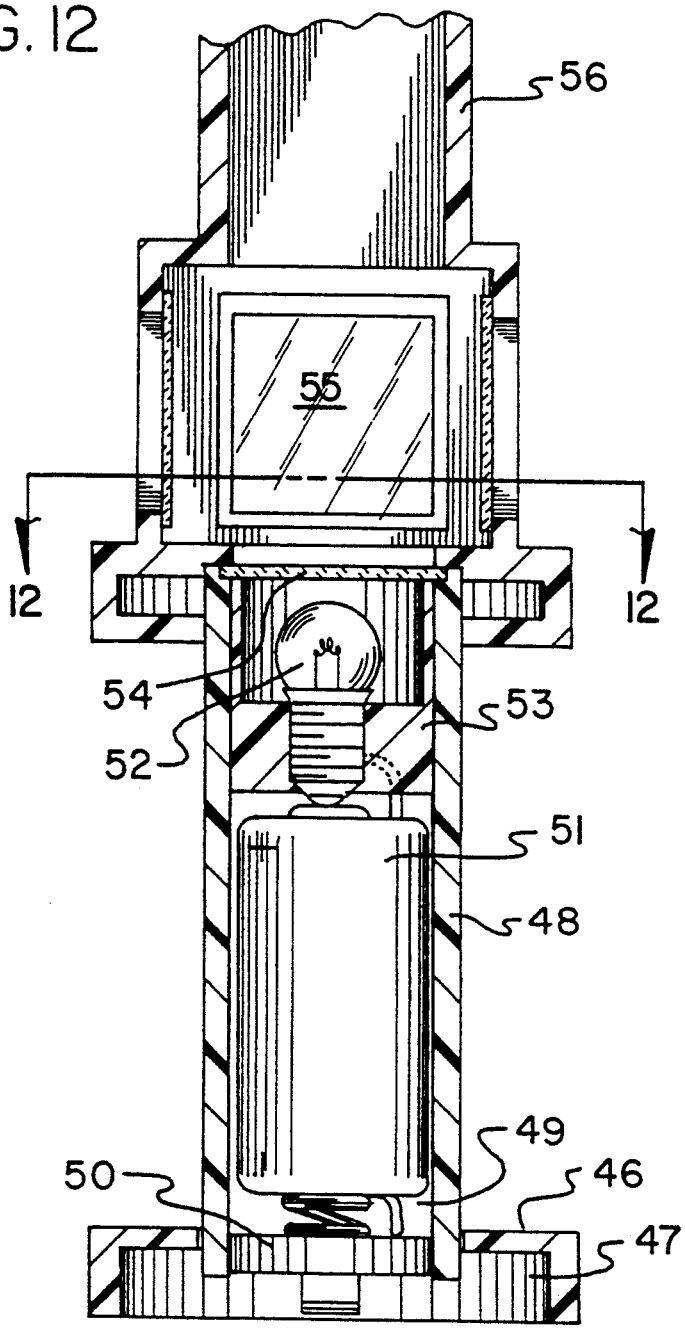
FIG. 11 is an orthographic view, taken along the lines 11—11 of FIG. 6 in the direction indicated by the arrows.

With reference now to the drawings, and in particular to FIGS. 1 to 13 thereof, a new and improved board game apparatus embodying the principles and concepts of the present invention and generally designated by the reference numeral 10 will be described.

More specifically, the board game apparatus 10 of the instant invention essentially comprises, with reference to FIG. 1, a housing container 18 having a lid and including a first compartment 19, a second compartment 20, a third compartment 21, a fourth compartment 22, a fifth compartment 23, and a sixth compartment 24 to maintain segregation of the various components of the organization. A deck of singles cards 12 and a deck of group cards 13 are provided arranged for reception within the respective singles card space 12*a* and the group card space 13*a* in diametrically opposed positions on the game board 11 with the game path 25 that is directed in adjacency to the periphery of the game board. The singles cards 12 are employed when individual players are in a position relative to one another, wherein group cards 13 are utilized in lieu of the singles cards when teams of players are employed in a positioned relative to one another.

Simulated dollar denominations 14 are positioned within the second compartment 20, with the game board 11 positioned within the first compartment 19. The third compartment 21 receives simulation property deeds 15, wherein the fourth compartment 22 receives the game tokens 16 afforded each player or team, and the chance members are dice pair 17. The fifth and sixth compartments 23 and 24 respectively receive the respective singles and group cards 12 and 13.

A game path 25 originates with a start space 26, wherein a player upon passage of such a start space in play of the game receives a predetermined first dollar amount. The game path includes various debit and credit spaces 27 and 28 respectively to effect the payment or receipt of payment from the game's bank that is in possession of a desired quantity of money to effect continuous play of the game, and wherein the debit and credit spaces direct players to pay and receive various dollar amounts in play of the game as hazards and rewards in play of the game. The path includes also a plurality of singles and doubles play spaces 29 and 30, wherein in individual players in opposition relative to one another, a top card is removed from the singles card deck 12, wherein alternatively in team play, a top card is drawn from the group cards 13. The singles and group cards direct players to respond in answering various trivia questions, as well as to direct activities such as directing players to effect certain acts such as dancing and the like to continue play. An auction space 31 within the game path 25 directs a player landing upon this space to auction a property for sale based upon original purchase price of the property. Other players may enter to purchase the property and wherein the dice pair 17 is thrown to permit players in a sequential order of hierarchy to offer bids for such property. A plurality of realty property spaces are provided to include the castle property spaces 34*a* and the sky scraper spaces 34*b* directing players to pay various quantities and dollar amounts to acquire either a castle or a sky scraper. Yacht acquisition spaces 35 are provided to permit players to acquire a yacht simulation to accommodate a certain category, to be discussed in more detail below. Aircraft acquisition spaces 37 are afforded for the same purpose. Sell property space 38 is also afforded to direct a player or group to sell one of the properties of the realty properties 34*a* and 34*b*, a yacht property, a beach property acquired through landing upon a beach property space 36, or an aircraft acquired through the aircraft acquisition space 37. It should be noted that all such properties and acquisitions are achieved upon landing of the appropriate spaces, as noted.

An object of the game is to acquire property in each of four categories of property. The first category includes acquisition of a yacht through a yacht space 35 and/or an aircraft through an aircraft acquisition space 37. The second category includes acquisition of a castle property landing upon a castle space 34*a*; a third category requires acquisition of a beach property upon landing upon a beach property space 36; and a fourth category acquires the acquisition of either or both a jewelry acquisition space 33 or a sky scraper through a sky scraper space 34*b*.

Upon achieving fulfillment of acquiring property in each of the four categories, a player upon landing upon one of the crown spaces 32 is required to respond to the questioning appropriately of a plurality of questions of arbitrary construction from either a singles card of the deck of singles cards 12 or of a group card of the deck of group cards 13. Upon landing upon an opposing player's property, tax payment of arbitrary and a second predetermined quantity is paid by the player landing upon such space. Further, should the player land upon an opposing player's yacht or vehicle of any type associated with transportation, that player may direct a landing player to any space such as the sell property space 38 or the auction space 31. Further, a player landing upon his own transportation property space in association with a vehicle of transportation such as an airplane or car, that player may also be transported to an alternating space within the game path 25. Further, a player may pay for property in a plurality of payments but must land on that property space in sequential movements about the game board. It should be noted that an exception to the landing upon a desired space is the start space where the players receive a third predetermined quantity of simulation money to continue play of the game.

Various card games in the deck may include games to direct activity such as dancing, singing, and the like, as well as the use of a "pirate card" where upon obtaining this card, one property may be obtained from each opposing player or alternatively, the use of a police card when a player having a pirate card is directed to return such properties.

Acquisition tokens may be provided, as indicated in the FIGS. 4–10, to provide players with such tokens to denote such acquisition of property, such as the beach property, yacht, and the like. To this end, the first, second, third, fourth, fifth, sixth, and seventh acquisition tokens 39–44*a* are indicated in the FIGS. 4–10.

Each such token includes a hollow base 46 having a hollow base cavity 47, with a pedestal cylindrical housing 48 mounted thereon. The pedestal housing 48 includes a housing cavity 49. An on/off switch plate 50 accessed through the hollow base 46 is in electrical communication with a battery 51 contained within the housing cavity 49. An illumination bulb 52 mounted within an illumination bulb web 53 at an upper portion of the cylindrical housing 48 is selectively illuminated through use of the on/off plate switch 50 and the battery 51. Communication between the illumination bulb and the switch of the on/off switch 50 is of conventional electrical circuitry utilizing DC current. A translucent lens 54 is mounted orthogonally relative to the axis of the cylindrical housing 48 above the translucent lens 54. A transparent window 55 is mounted above the translucent lens 54 within a token simulation member 56. In this manner, illumination is directed through the translucent lens 54 through the at least one window 55. The translucent lenses are of various colorations for indication of contrasting properties thusly acquired. In this manner, upon acquisition of a property, a player merely illuminates an associated acquisition token for visual indication of achievement of various categories required in play of the game.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A board game apparatus, comprising, a foldable game board, and a deck of first cards having a plurality of first question cards for use by individual players, and a deck of second cards having a plurality of second question cards for use by groups of said second players, and simulated dollar denominations, and a plurality of property deeds, and a plurality of movement tokens one for each player for movement along the game board path, and a dice pair, and a housing container, the housing container including a first compartment, wherein the first compartment is arranged to receive said game board, and a second compartment, wherein the second compartment is arranged to receive said simulated dollar denominations, and a third compartment wherein the third compartment is arranged to receive the property deeds, and a fourth compartment to receive said tokens and said dice pair, and a fifth compartment to receive said deck of first cards, and a sixth compartment to receive said deck of second cards, and the game board includes a continuous game path directed about a periphery of the game board, the game path includes a plurality of adjacent spaces, wherein one of said spaces includes a start space to initiate play of said game, and a plurality of debit spaces to direct individual players to pay predetermined penalties, and at least one credit space to direct players to receive a reward, and a plurality of singles play spaces to direct players to select a first question card of said deck of said first cards, and a plurality of doubles play spaces in said game path to direct a player to receive a second question card of said deck of second cards when players play as said group, and said game path includes a plurality of property spaces to include a plurality of castle property spaces and a plurality of sky scraper property spaces, and each of said property spaces is associated with one of said property deeds, wherein a player obtains a property through one of said property spaces, said player receives an associated property deed relative to respective property space, and a plurality of acquisition tokens each acquisition token having a figure simulating a property represented on one of said property spaces, to visually indicate acquisition of said property, said acquisition tokens representing each of said plurality of property spaces, and each acquisition token includes a hollow base, the hollow base having a hollow base cavity, with an on/off switch directed within said hollow base cavity, and a pedestal housing orthogonally mounted on said hollow base, said pedestal housings having a housing cavity, the housing cavity including a battery, and an illumination bulb web mounted within said pedestal housing above said battery, and said illumination bulb web mounting an illumination bulb, and the illumination bulb, the battery, and the on/off switch arranged in electrical communication relative to one another to effect selective illumination of said illumination bulb, and a translucent lens mounted within an upper distal end of said pedestal housing above said illumination bulb, wherein said translucent lens is of a predetermined coloration, and said figure simulating said property mounted fixedly to an upper distal end of said pedestal housing over said translucent lens, and said figure simulating said property includes a transparent window, and the transparent window is in optical communication with said illumination bulb to direct illumination of said illumination bulb through said translucent lens and said window to permit visual indication of acquisition of said property.

* * * * *